United States Patent [19]

Shoji et al.

[11] Patent Number: 4,673,596

[45] Date of Patent: Jun. 16, 1987

[54] PROCESS FOR PRODUCING DECORATIVE SHEET

[75] Inventors: Toru Shoji, Misato; Mitsuru Sugiyama, Noda; Makoto Takezawa, Nagareyama; Yuichi Akiba, Tokyo; Akira Kaneko, Yono; Mituo Sato, Tokyo, all of Japan

[73] Assignee: Lonseal Corporation, Tokyo, Japan

[21] Appl. No.: 775,953

[22] Filed: Sep. 13, 1985

Related U.S. Application Data

[63] Continuation of Ser. No. 621,662, Jun. 18, 1984, abandoned.

[30] Foreign Application Priority Data

Jun. 24, 1983 [JP] Japan ..... 58-114791

[51] Int. Cl.[4] ..... B05D 3/02; B05D 5/06

[52] U.S. Cl. ..... 427/262; 427/263; 427/264; 427/265; 427/267; 427/268; 427/270

[58] Field of Search ..... 427/262, 263, 267, 268, 427/280, 281, 264, 265, 270

[56] References Cited

FOREIGN PATENT DOCUMENTS

| | | | |
|---|---|---|---|
| 2423661 | 11/1975 | Fed. Rep. of Germany | 427/264 |
| 42-5430 | 3/1967 | Japan . | |
| 43-28636 | 12/1968 | Japan . | |
| 49-46134 | 12/1974 | Japan . | |
| 53-8569 | 3/1978 | Japan . | |
| 56-39945 | 9/1981 | Japan . | |
| 57-6980 | 2/1982 | Japan . | |
| 956128 | 4/1964 | United Kingdom | 427/268 |

*Primary Examiner*—Evan K. Lawrence

*Attorney, Agent, or Firm*—Sandler & Greenblum

[57] ABSTRACT

In the production of a decorative sheet, a synthetic resin paste is first applied onto the upper surface of a substrate sheet to form an undercoat layer. Then, one or more pastes, each being of the same material and having approximately the same viscosity as the paste of the undercoat layer, are laterally sprayed so as to drop onto the undercoat layer. The result is a smoothing phenomenon, with the pattern layer cooperating with the undercoat layer to form a smooth patterned surface. Finally, the pattern layer is heated and jelled.

20 Claims, 4 Drawing Figures

PROCESS FOR PRODUCING DECORATIVE SHEET

This application is a continuation of application Ser. No. 621,662, filed June 18, 1984 now abandoned.

BAGKGROUND OF THE INVENTION

1. Field of the Invention

The present invention relates to a novel process for producing a decorative sheet having a marbled or other pattern. More particularly, the present invention produces a decorative sheet, having a marble or terrazzo pattern which is usable as a floor finish or wall covering, by spraying a mono- or multiple-colored synthetic resin paste onto a substrate sheet by means of a spraying system.

2. Description of the Material Information

Floor finishes, particularly those made of synthetic resins, of which a typical example is a vinyl chloride resin, have been used in various applications because they can be freely colored and used for various decorative purposes.

To impart a decorative effect to these synthetic resin floor finishes, it is necessary not only merely to stimulate one's desire to purchase, but also to impart an air of residential comfortability and the metallic effects provided by the decorative effect.

Therefore, the decorative effects to be imparted to synthetic resin floor finishes, and the methods or means for imparting a specific decorative effect, have been vigorously studied. As a result, a number of inventions and devices have been proposed. However, these conventional synthetic resin floor finishes are disadvantageous in that some of them are poor in durability or abrasion resistance although they exhibit a highly decorative effect, while the other finishes are often poor in decorative effect although they are excellent in durability or abrasion resistance.

For example, Japanese Examined Patent Publication No. 43-28636 describes a well known and original invention of Kongorium Co., Ltd. relating to a cushioned or resilient floor produced by a so-called chemical embossing method. The floor finish obtained by the invention described in the above-mentioned publication exhibits a very excellent decorative effect. This decorative effect is provided only under a special condition of the presence of both a printed layer and a foamed layer. However, the durability of this floor finish is very poor and, when the printed layer is abraded, the beauty of the floor finish disappears.

The invention described in Japanese Examined Patent Publication No. 42-5430 relates to a process which comprises adhering small pieces of synthetic resin tiles onto the surface of a roll by means of a suction force exerted by the roll, and then transferring the pieces to a substrate having an adhesive applied thereon. The floor finish obtained by this process exhibits an excellent durability because the small pieces of synthetic resin tiles constitute the component units of the floor finish. However, this process is disadvantageous in that the adherence of the small pieces onto the suction roll is not uniform and the spacings between the small pieces are irregular, i.e., the arrangement of the small pieces is rough. Therefore, the decorative effect obtained by this process is not excellent.

Japanese Examined Patent Publication No. 53-8569 discloses a process for producing a floor finish by using small pieces made of synthetic resins. In this process, a technique similar to a printing technique is used in place of the suction roll technique. A patterned screen is placed on a substrate, and small pieces of synthetic resins are dropped thereon to form predetermined patterns. The resins, screen, and substrate are then pressed together to form a firm floor finish. This process, however, is disadvantageous for several reasons. The production of materials constituting the pattern, i.e., grains or crushed pieces of colored synthetic resins, is complicated. The resulting patterns are unclear, especially at the junctions corresponding to the lines of the pattern screen. The small pieces of synthetic resins are likely to flow during pressing. Improper pressing creates voids in the final product and, sometimes, an unevenness in the distribution of the dropped pieces. Obtaining a uniform, homogeneous floor finish by this process is therefore difficult.

SUMMARY OF THE INVENTION

The present invention is a process for producing a decorative sheet exhibiting an excellent decorative effect, and which process is quite different from the abovementioned conventional processes for producing a floor finish. The resulting decorative sheet is usable as a floor finish or a wall covering.

According to the invention, a process for producing a decorative sheet is disclosed which comprises applying a synthetic resin paste onto the upper surface of a substrate sheet to form an undercoat layer, then laterally spraying one or more colored synthetic resin pastes onto the undercoat layer so as to cause each of the sprayed pastes to be dropped onto the undercoat layer, and then heating and gelling the pattern layer.

The undercoat layer may comprise the same material as, having approximately the same viscosity as, the pattern layer. Further, the undercoat layer may be a colorless transparent synthetic resin, a colored transparent synthetic resin, or a colored opaque synthetic resin. The synthetic resin paste of the undercoat layer may be of a different color than the synthetic resin paste of the pattern layer.

The synthetic resin paste of the pattern layer may be of a single color, and may be dropped onto the undercoat layer in the form of a drop or a string. The pattern layer may be formed by simultaneously, laterally spraying, onto the undercoat layer, a plurality of synthetic resin pastes having a plurality of colors.

The spraying system may be multiheaded and charged with a plurality of synthetic resin pastes having a plurality of colors. Where the spraying system is multiheaded, the synthetic resin pastes may be sprayed onto the undercoat layer either simultaneously or sequentially.

According to yet another aspect of the invention, a transparent protective layer may further be formed on top of the pattern layer subsequent to the gelling of the pattern layer.

In order that the invention may be more clearly understood, preferred embodiments will be described, by way of example, with reference to the accompanying drawings.

BRIEF DESCRIPTION OF THE DRAWINGS

The drawings show an example of the process for producing a decorative sheet according to the present invention, wherein.

DETAILED DESCRIPTION OF THE PREFERRED EMBODIMENTS

Figure 1:
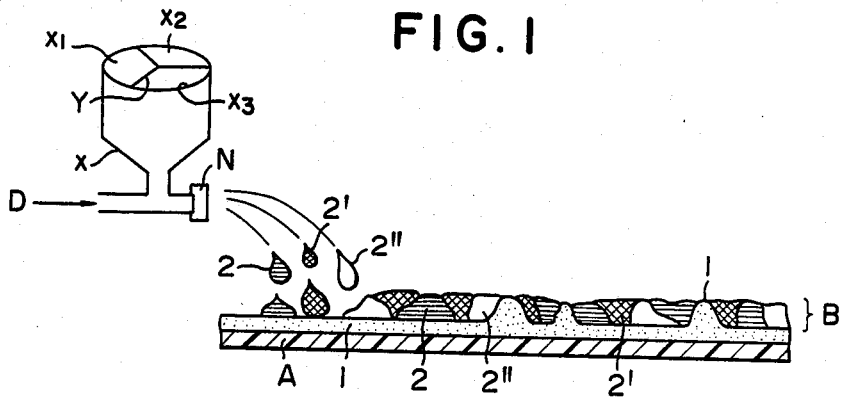
FIGS. 1 and 2 are flow sheets showing the production process.
Figure 2:
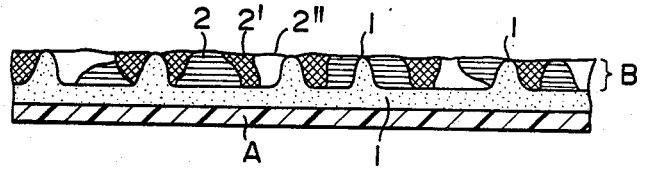
Figure 3:
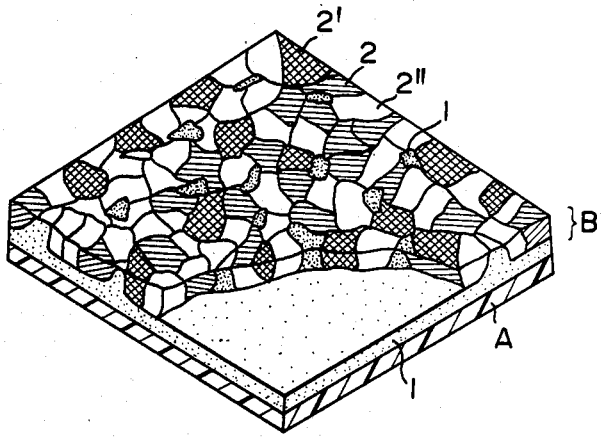
FIG. 3 is a partially broken perspective view of the produced decorative sheet.
Figure 4:
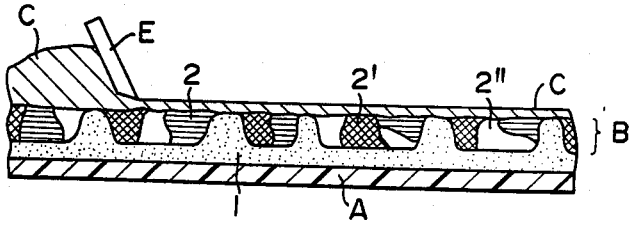
FIG. 4 is a cross-sectional view showing another production process.

A paste of a transparent or colored synthetic resin is applied on the upper surface of substrate sheet A to form an undercoat layer 1. Pastes 2, 2', 2'' . . . , of colored synthetic resins are sprayed on undercoat layer 1 in a lateral direction by means of spray gun X to cause the pastes to be dropped in the form of a drop or a string thereon, thereby forming pattern layer B (FIG. 1). Thereafter, undercoat layer 1 and pattern layer B are gelled with heat to produce a decorative sheet having surface smoothness and having a novel marble pattern or raised terrazzo pattern.

Suitable materials for substrate sheet A in the present invention include synthetic resins, such as a vinyl chloride, asbestos paper, and unwoven fabric made of glass. Any of the above-mentioned materials impregnated with a binder would also be suitable. The synthetic resin sheets usable as the substrate sheet of the present invention are those which are obtained by subjecting soft type synthetic resins well known in the art to any conventional sheet forming method, such as a calendering method, a knife coating method, and a roll coating method. One example of such soft type synthetic resins is, as previously mentioned, a vinyl chloride resin. Copolymers of vinyl chloride and other comonomers, such as vinyl chloride-vinyl acetate copolymers, are also suitable, as is vinyl chloride resin containing other resin components having an affinity for the vinyl chloride resin, such as NBR and rubber. If the synthetic resin sheet is used, it may have a backing. The backing may be a woven fabric such as hemp or vinylon, or an unwoven fabric made of glass, or a polyester or the like, or asbestos paper.

The transparent or colored synthetic resin paste used for forming undercoat layer 1 is composed of a vinyl chloride resin or a vinyl chloride copolymer. Preferable vinyl chloride resins are those of so-called paste grade which are obtained by an emulsion polymerization method or a microsuspension polymerization method. In addition to these vinyl chloride type resins, an ethylene-vinyl acetate emulsion and an acrylic resin emulsion may be used.

In the present invention, undercoat layer 1 exhibits a very important action and effect in connection with pattern layer B. Undercoat layer 1 not only functions as an adhesive layer for bonding pattern layer B to substrate sheet A, but also constitutes a part of pattern layer B. Furthermore, undercoat layer 1 is very effective for smoothing sprayed pattern layer B. Where undercoat layer 1 comprises the same material as, and has almost the same viscosity as, the colored synthetic resin pastes of pattern layer B, sprayed colored synthetic resin pastes 2, 2', 2'' . . . , flow slowly and smoothly on undercoat layer 1 immediately after being sprayed, so that a part of undercoat layer 1 is incorporated into resultant pattern layer B. If undercoat layer 1 is not provided, the sprayed colored paste may be retained in the state of a drop or string, or may flow to a slight degree, depending on the type of substrate sheet A, so that substrate sheet A, throughout its surface, has a number of portions not coated with the colored paste. This result is due to the magnitude of surface tension of the sprayed colored paste (this is determined in connection with the substrate sheet). The presence of the non-coated portions is a serious defect in the production process, and accordingly in the quality of the resultant decorative sheet. It is, therefore, surprising that the present invention eliminates this defect by the simple means of providing an undercoat layer.

Most preferably, the transparent or colored synthetic resin paste used to form undercoat layer 1 comprises the same material as, and has almost the same viscosity as, colored synthetic resin pastes 2, 2', 2'' . . . , constituting the pattern layer.

Therefore, when a vinyl chloride resin paste is sprayed as pattern layer B, it is preferable that a vinyl chloride resin paste having the same formulation as this colored paste be used as undercoat layer 1. Also, when an acrylic resin emulsion is used as pattern layer B, an acrylic resin emulsion is generally used for undercoat layer 1. In the case where a vinyl chloride resin paste is used as undercoat layer 1, and an acrylic resin emulsion is used as the colored paste of pattern layer B, the above-mentioned smoothing phenomenon does not occur; rather, the sprayed colored synthetic resin paste is aggregated, resulting in protuberances.

Undercoat layer 1 may have a colorless transparency, a colored transparency, or a colored opaqueness, depending on the type and state of substrate sheet A and the colored synthetic resin paste to be sprayed. For example, when substrate sheet A itself is a soft vinyl chloride resin sheet having a beautiful color tone, a synthetic resin paste having a colorless transparency is used as undercoat layer 1 and a colored synthetic resin paste having a different color from substrate sheet A is used as pattern layer B. Thus, a novel marble pattern is formed in which the color of substrate sheet A constitutes a part of pattern layer B. Where a synthetic resin paste having a colored opaqueness is used as undercoat layer 1, the color of the colored synthetic resin paste to be sprayed may be changed to obtain a smooth decorative sheet in which the color of undercoat layer 1 constitutes a part of pattern layer B.

Colored synthetic resin pastes 2, 2', 2'' . . . , from which pattern layer B is formed by a spray method, may be of the same composition as the paste of undercoat layer 1. Furthermore, although one color of synthetic resin paste is generally used, colored synthetic resin pastes of two or more different colors may also be used.

Where the colored synthetic resin paste to be sprayed has a single color, changing the color of undercoat layer 1 results in a two-color effect. Also, when colored synthetic resin pastes having a plurality of colors are to be sprayed, these colored synthetic resin pastes may be simultaneously sprayed. In this case, most of the sprayed colored pastes, dropped in the form of a drop or string, retain the original colors; a part of them have a color resulting from the blending of these individual colors. The resultant pattern is very intricate and beautiful, and the resultant decorative sheet exhibits a natural and extremely unique decorative effect which could not previously have been realized.

Spray gun X suitable for the purpose of the present invention is usually one having a large caliber, for example, an Internal mixtype gun having a caliber of 5 to 8 mm. A coating well of the spray gun is partitioned by partition Y. The number assigned to the compartment corresponds to the number of the color of synthetic resin paste placed therein. In the case of FIG. 1, three differently colored synthetic resin pastes 2, 2', and 2'' are used. Therefore, the coating well is divided into three compartments $X_1$, $X_2$ and $X_3$ by partition Y, and the colored synthetic resin pastes 2, 2', and 2'', being of different colors, are introduced into compartments $X_1$, $X_2$ and $X_3$, respectively. Then, compressed air D is blown into spray gun X to spray the pastes through nozzle N located at the bottom of the coating well. In this case, it is important that the colored synthetic resin pastes are laterally sprayed along a direction parallel to substrate sheet A, as shown in FIG. 1. Since the colored paste has a relatively high viscosity of 2000 to 5000 cps, if the paste is sprayed directly on the substrate sheet surface (i.e., sprayed in a direction perpendicular to the substrate sheet surface), the sprayed colored paste will not be separated to a satisfactory degree; partial unevenness in the pattern, as well as local excessive deposition, will result. In accordance with the lateral spraying method of the present invention, when the pastes are sprayed from the spray gun, most of the sprayed pastes become drop-like, due to their surface tension, before they are deposited on the substrate sheet surface. Part of the pastes are deposited in a slightly thready state, i.e., in the form of a string, on the substrate sheet surface. Therefore, the colors of the colored pastes are uniformly distributed, no partial excessive deposition occurs, and a uniform pattern is obtained.

The coating thickness of the colored paste varies according to the end use of the product, and is usually in the range of 0.2 to 2.0 mm.

Where mass production is carried out, or a decorative sheet having a large width is produced, it is preferable to use a multihead spray gun rather than a singlehead spray gun. That is, spray guns corresponding to the number of colors are respectively charged with colored pastes of different colors, and the charged colored pastes are sprayed simultaneously, separately or sequentially.

After pattern layer B, consisting of colored synthetic resin pastes 2, 2', 2'' . . . , is formed in this manner, it is left to stand for a period of 30 seconds to one minute so as to smooth the layer. Then, the pattern layer B is passed to a heating furnace wherein it is gelled or dried. Thus, a decorative sheet having a novel and unique pattern, which could not hitherto have been realized, is obtained.

The resultant decorative sheet may be directly used as a floor finish or for other applications. If necessary, transparent protective layer C may be further formed on the surface of the pattern layer. Transparent protective layer C serves to further enhance the smoothness of the upper surface of the decorative sheet, and, at the same time, to impart various functions to the decorative sheet, such as stain resistance, abrasion resistance, heel mark resistance and cigarette resistance.

The decorative sheet made by the process of the present invention has excellent surface smoothness because of the presence of the undercoat layer as described hereinabove. Accordingly, little surface coating is necessary for smoothing. Rather, the above-mentioned transparent protective layer serves primarily for imparting additional functions to the decorative sheet, and for enhancing the inherent functions of the sheet.

For example, when a vinyl chloride resin paste containing a plasticizer having excellent stain resistance, such as, butyl benzyl phthalate, is used to form a rigid, transparent protective layer, the resultant decorative sheet exhibits excellent abrasion resistance and stain resistance.

Also, when an ultraviolet cured coating of urethaneacryl type is formed on the surface of the decorative sheet, it is possible to remove the deposition of a black, ugly heel mark caused by friction between rubber-soled shoes and the sheet.

Further, application of a polyurethane resin emulsion is extremely useful for improving abrasion resistance. Application of a polymethacrylate resin solution, or lamination of a polymethacrylate resin film, is extremely useful for improving stain resistance.

It is natural that application of any figures on the smooth surface of the decorative sheet further enhances the decorative effect of the sheet, irrespective of the presence of a transparent protective layer. Such a technique may be optionally practiced. A combination with a Valley print and embossing is also useful.

Embodiments of the present invention are illustrated by the following examples.

EXAMPLE 1

(1) Production of substrate sheet A made of a synthetic resin

| Formulation (1) | |
|---|---|
| Vinyl chloride resin ($\bar{p}$ = 1000) | 100 parts by weight |
| DOP | 45 parts by weight |
| Epoxidized soybean oil | 5 parts by weight |
| Stabilizer | 3 parts by weight |
| Filler (calcium bicarbonate) | 30 parts by weight |
| Colorant (green) | appropriate amount |

The above-mentioned formulation (1) was subjected to a calendering process to obtain a sheet having a thickness of 0.45 mm. The sheet was laminated on a backing fabric to obtain green substrate A having a thickness of 0.6 mm.

(2) Application of undercoat layer 1

| Formulation (2) | |
|---|---|
| Zeon 121*[1] | 100 parts by weight |
| DOP | 40 parts by weight |
| TX1B*[2] | 10 parts by weight |
| Stabilizer | 3 parts by weight |
| Viscosity modifier | appropriate amount |

*[1]a vinyl chloride resin for a paste, manufactured by Nippon Zeon Co., Ltd.
*[2]TEXANOL isobutylate plasticizer The formulation (2) was mixed in a paste kneader equipped with a vacuum suction apparatus to obtain a transparent vinyl chloride resin paste having a viscosity of 3500 cps to 4000 cps. The resultant undercoat paste was coated in a thickness of 0.4 mm on green substrate sheet A obtained in (1) above, so that the total thickness of substrate sheet A and resultant undercoat layer 1 was 1.0 mm.

(3) Spraying of pattern layer B

| Formulation (3) | |
|---|---|
| Zeon 121 | 60 parts by weight |
| Blending resin | 40 parts by weight |
| DOP | 40 parts by weight |
| TX1B | 10 parts by weight |
| Stabilizer | 3 parts by weight |
| Filler | 30 parts by weight |
| Viscosity modifier | appropriate amount |

-continued

| (3) Spraying of pattern layer B | |
|---|---|
| Formulation (3) | |
| Colorant toner | appropriate amount |

A composition having, as a basic formulation, the formulation (3), was mixed in a paste kneader equipped with a vacuum suction apparatus. Dark brown, light brown and white toners were used as the colorant toners to prepare three types of pastes.

The blending resin in the formulation (3) is effective for preventing the paste from threading during spraying. Where the blending resin is not used, the sprayed pastes are likely to thread, and do not take the shape of a drop or string. Zeon 103 ZX (manufactured by Nippon Zeon Co., Ltd.) is suitable as the blending resin. Each paste of the formulation (3) is adjusted to a viscosity of 4,000 cps by using the viscosity modifier. It is important to adjust these pastes to almost the same vicosity, since if there is a difference between the pastes, they can not be uniformly sprayed. The three colored pastes were respectively introduced into compartments $X_1$, $X_2$, and $X_3$ of spray gun X, with compartments as shown in FIG. 1, and were laterally sprayed on substrate sheet A coated with the undercoat layer 1 under the following conditions.

| Spraying condition | |
|---|---|
| Spray gun | suitable for resin |
| Caliber | 6 mm |
| Air nozzle diameter | 2.0 mm |
| Air pressure | 2 kg/cm$^2$ |

The larger the caliber of the spray gun, the larger is the size of the resultant drop or string; the smaller the caliber of the spray gun, the smaller is the size of the resultant drop or string. When a spray gun having a small caliber, such as 2 to 3 mm, is used, the extruding rate is small and the resultant pattern is fine. Therefore, a small spray gun is not preferred.

The coating thickness of pattern layer B is in the range of approximately 1.0 to 1.2 mm for a floor finish.

Pattern layer B basically exhibits a spot pattern of dark brown, light brown and white. The white portion of pattern layer B includes a protruded portion of undercoat layer 1.

After spraying, smoothing was carried out on the resultant sheet for approximately 30 seconds to one minute. Then, the sheet was introduced into a heating furnace heated to 160° C., where pattern layer B was heated and gelled. Thereafter, the sheet was cooled by a cooling roll, and was wound.

The resultant decorative sheet had a thickness of 2.0 to 2.2 mm, and exhibited an extremely beautiful design in which green dots were partially distributed in a spot pattern of dark brown, light brown and white. In addition, the decorative sheet had a very smooth surface including no unevenness.

The decorative sheet was suitable for use as a floor finish.

| Coating of transparent protective layer C | |
|---|---|
| Formulation (4) | |
| Zeon 121 | 100 parts by weight |
| DOP | 15 parts by weight |

-continued

| Coating of transparent protective layer C | |
|---|---|
| Formulation (4) | |
| BBP | 20 parts by weight |
| Epoxidized soybean oil | 3 parts by weight |
| Stabilizer | 3 parts by weight |
| Viscosity modifier | appropriate amount |

The formulation (4) was mixed in the same manner as the formulation (2) in order to prepare a transparent paste having a viscosity of 10,000 cps.

Then, by means of doctor knife E, a 0.2 mm thick layer of the paste was coated on a decorative sheet 2.0 to 2.2 mm thick, as obtained in the step (3). After cooling, the resultant decorative sheet had a high surface hardness, an excellent abrasion and stain resistance, and a very beautiful appearance. The decorative sheet was suitable for use as a floor finish intended for heavy traffic.

As described hereinabove, a decorative sheet having a marble pattern or a terrazzo pattern, exhibiting a highly decorative effect as well as excellent durability and abrasion resistance, is simply and rapidly obtained. Therefore, the desired purpose of the present invention is achieved.

It is further understood by those skilled in the art that the foregoing description is that of preferred embodiments of the disclosed invention, and that various changes and modifications may be made in the invention without departing from the spirit and scope thereof.

What is claimed is:

1. A process for producing a decorative sheet, comprising the steps of:

(a) applying a paste comprising a synthetic resin onto the upper surface of a substrate sheet to form an undercoat layer;

(b) laterally spraying, by means of a spraying system, one or more pastes, each paste comprising colored synthetic resin of the same material and having approximately the same viscosity as the paste comprising the undercoat layer, onto the undercoat layer so as to cause each of the one or more pastes to be dropped onto the undercoat layer, whereby a smoothing phenomenon occurs wherein the one or more pastes forming a pattern layer cooperate with the undercoat layer to form a smooth patterned surface; and (c) heating and gelling the pattern layer.

2. The process of claim 1 wherein the undercoat layer comprises a synthetic resin selected from the group consisting of colorless transparent synthetic resin, colored transparent synthetic resin, and colored opaque synthetic resin.

3. The process of claim 2 comprising forming a transparent protective layer on top of the pattern layer subsequent to the gelling of the pattern layer.

4. The process of claim 1 wherein the synthetic resin paste of the undercoat layer is of a different color than the synthetic resin paste of the pattern layer.

5. The process of claim 4 wherein the synthetic resin paste of the pattern layer is of a single color.

6. The process of claim 5 comprising forming a transparent protective layer on top of the pattern layer subsequent to the gelling of the pattern layer.

7. The process of claim 4 comprising forming the pattern layer by simultaneously, laterally spraying, onto the undercoat layer, a plurality of synthetic resin pastes having a plurality of colors.

8. The process of claim 7 comprising forming a transparent protective layer on top of the pattern layer subsequent to the gelling of the pattern layer.

9. The process of claim 4 comprising forming the pattern layer by laterally spraying, onto the undercoat layer, by means of a multihead spraying system, a plurality of synthetic resin pastes having a plurality of colors.

10. The process of claim 9 wherein the synthetic resin pastes are sprayed simultaneously.

11. The process of claim 9 wherein the synthetic resin pastes are sprayed sequentially.

12. The process of claim 11 wherein the synthetic resin pastes are dropped onto the undercoat layer in forms selected from one or more of the group consisting of drop forms and string forms.

13. The process of claim 9 comprising forming a transparent protective layer on top of the pattern layer. subsequent to the gelling of the pattern layer

14. The process of claim 4 comprising forming a transparent protective layer on top of the pattern layer subsequent to the gelling of the pattern layer.

15. The process of claim 14 wherein the synthetic resin paste of the pattern layer is of a single color.

16. The process of claim 15 comprising forming a transparent protective layer on top of the pattern layer subsequent to the gelling of the pattern layer.

17. The process of claim 1 wherein the synthetic resin paste of the pattern layer is of a single color.

18. The process of claim 17 comprising forming a transparent protective layer on top of the pattern layer subsequent to the gelling of the pattern layer.

19. The process of claim 1 comprising forming the pattern layer by simultaneously, laterally spraying, onto the undercoat layer, a plurality of synthetic resin pastes having a plurality of colors.

20. The process of claim 19 comprising forming a transparent protective layer on top of the pattern layer subsequent to the gelling of the pattern layer.

* * * * *

UNITED STATES PATENT AND TRADEMARK OFFICE

CERTIFICATE OF CORRECTION

PATENT NO. : 4,673,596

DATED : June 16, 1987

INVENTOR(S) : Toru SHOJI et al.

It is certified that error appears in the above-identified patent and that said Letters Patent is hereby corrected as shown below:

At column 1, line 8, change "BAGKGROUND" in the heading to ---BACKGROUND---.

At column 2, line 24, change "abovementioned" to ---above-mentioned---.

At column 7, line 65, insert ---(4)--- before the underlined heading.

At column 8, line 2, insert ---(4)--- before the underlined heading.

Signed and Sealed this

Seventeenth Day of January, 1989

*Attest:*

DONALD J. QUIGG

*Attesting Officer*

*Commissioner of Patents and Trademarks*